United States Patent [19]

Kataishi et al.

[11] 4,406,608

[45] Sep. 27, 1983

[54] RELEASING APPARATUS

[75] Inventors: Takao Kataishi; Iwazou Seo, both of Tokyo, Japan

[73] Assignee: Misawa Home Co., Ltd., Tokyo, Japan

[21] Appl. No.: 313,131

[22] Filed: Oct. 20, 1981

[30] Foreign Application Priority Data

Apr. 14, 1981 [JP] Japan ..... 56-55799

[51] Int. Cl.[3] ..... B28B 7/08; B28B 7/10

[52] U.S. Cl. ..... 425/436 RM; 425/438; 425/442; 425/443

[58] Field of Search ..... 425/436 RM, 438, 442, 425/443, 441

[56] References Cited

U.S. PATENT DOCUMENTS

| | | | |
|---|---|---|---|
| 3,920,369 | 11/1975 | Boehringer et al. | 425/413 X |
| 4,181,485 | 1/1980 | Schramm | 425/441 X |

FOREIGN PATENT DOCUMENTS

| | | | |
|---|---|---|---|
| 1164912 | 3/1964 | Fed. Rep. of Germany | 425/441 |
| 2204785 | 8/1973 | Fed. Rep. of Germany | 425/441 |
| 2311977 | 9/1974 | Fed. Rep. of Germany | 425/442 |
| 96186 | 5/1972 | France | 425/441 |
| 2231201 | 12/1974 | France | 425/441 |
| 580984 | 11/1977 | U.S.S.R. | 425/442 |

*Primary Examiner*—Philip E. Anderson

*Attorney, Agent, or Firm*—Flynn, Thiel, Boutell & Tanis

[57] ABSTRACT

A releasing apparatus for removing a shuttering from a molding such as a concrete panel.

This releasing apparatus is of such an arrangement that an erectable frame for erecting and laying down a shuttering bed between a carry-in position and an erected position is erectedly provided on a base frame, a molding receiving mechanism is provided for receiving only a molding disposed on the shuttering bed in a state where the erectable frame is erected, and, after the molding has been received, the erectable frame is laid down to be ready for the succeeding shuttering bed to be carried in.

10 Claims, 7 Drawing Figures

RELEASING APPARATUS

BACKGROUND OF THE INVENTION

1. Field of the Invention

The present invention relates to a releasing apparatus for removing a shuttering and the like from a molding such as a light-weight concrete panel.

2. Description of the Prior Art

Heretofore, in removing a shuttering from a molding such as a concrete panel, after the curing of the concrete panel, the shuttering has been removed by the hand work at a very low working efficiency.

Furthermore, recently, necessities have been voiced for lighter materials for the residence construction and lowered costs of architectural structures, with the result that cellular concrete panels and the like have been used as panel materials. Even for these cellular concrete panels, releasing means usable at a high efficiency have been demanded from a necessity for shorter construction terms.

SUMMARY OF THE INVENTION

The present invention has as its object the provision of a releasing apparatus capable of removing a shuttering and the like form a molding such as a concrete panel at a high efficiency.

According to the present invention, an erectable frame for erecting and laying down a shuttering bed between a carry-in position and an erected position is erectedly provided on a base frame, molding receiving mechanisms are provided for receiving only a molding disposed on the shuttering bed in a state where the erectable frame is erected, and, after the molding has been received, the erectable frame is laid down to be ready for the succeeding shuttering bed to be carried in, thereby enabling to achieve the abovedescribed object.

The preferred embodiment of the present invention is a releasing apparatus comprising: a base frame; an erectable frame supported by the base frame and including a shuttering bed securing mechanism supported by the base frame for erecting a shuttering bed from a shuttering bed carry-in position to a shuttering bed upright position in a state where the shuttering bed is supported and for positively supporting only the shuttering bed while the shuttering bed is erected, and molding supporting mechanisms operable independently of the shuttering bed securing mechanism and abutting against a side surface of a molding formed on the shuttering bed directly or through portions of the shuttering to support the molding only; and molding receiving mechanisms provided on the base frame for receiving only the molding formed on the shuttering bed supported by the erectable frame in the erected state so as to allow the erectable frame to be laid down.

DETAILED DESCRIPTION OF THE PREFERRED EMBODIMENT

Figure 1:
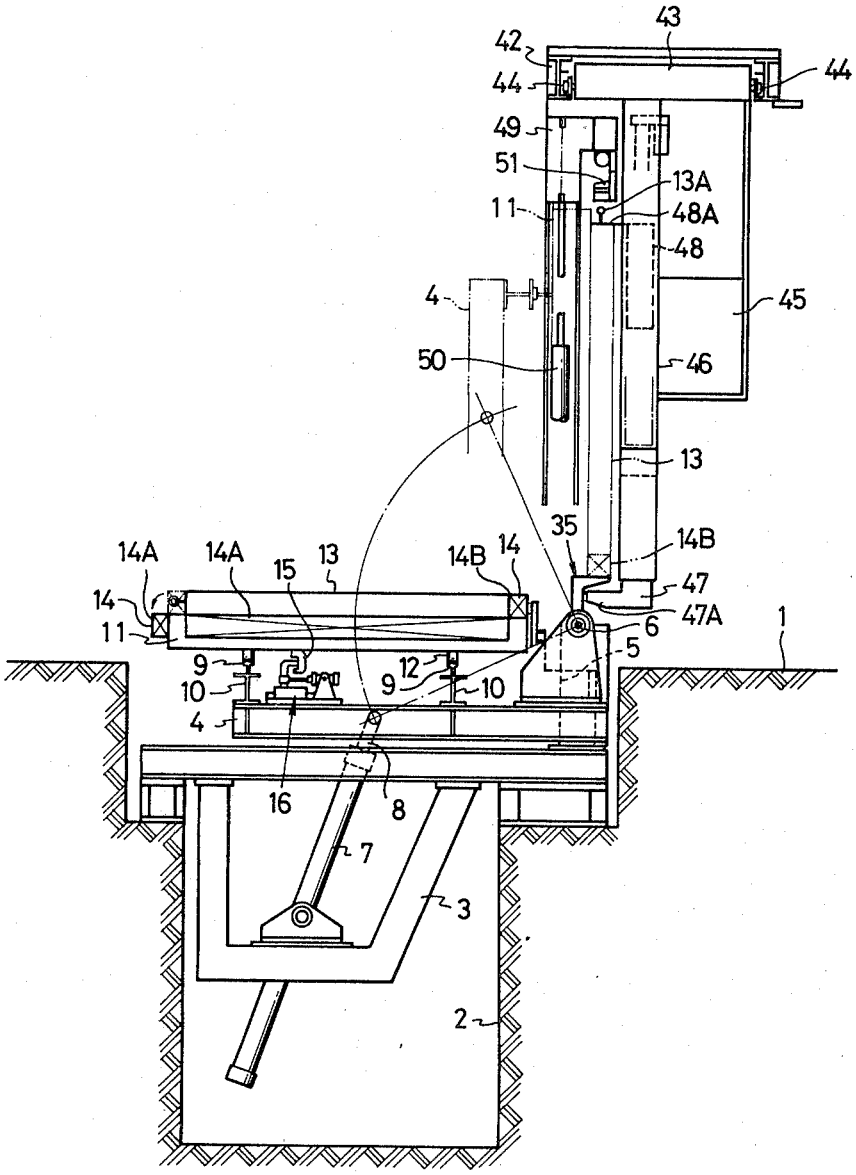
FIG. 1 is a side view showing the general arrangement of an embodiment of the releasing apparatus according to the present invention.

In FIG. 1 showing the general arrangement, a floor 1 is provided therein with a base frame for installing recess 2, in which a base frame 3 is installed. Erectably supported at one side of this base frame 3 through a pair of bearings 5 and a shaft 6 (Refer to FIG. 2) are opposite ends of one side portion of an erectable frame 4, and rotatably secured to the intermediate portion of this erectable frame 4 is the forward end of a piston rod 8 of a cylinder 7 being an erecting driving source. The intermediate portion of this cylinder 7 is rotatably mounted on a lower frame of the base frame 3, and the erectable frame 4 is adapted to erect, rotating about the shaft 6, from a carry-in position of a shuttering bed 11 to be described hereinafter, i.e. a horizontal position to a vertical (upright) position through the action of the rod 8 linearly movable through the action of the cylinder 7.

Laid through I-shaped steels 10 on the erectable frame 4 are a pair of rails 9, on which are movably mounted wheels 12 of a shuttering bed 11, so that the carry-in of the shuttering bed 11 can be effected in a horizontal state. Arranged on the shuttering bed 11 is a shuttering 14 for defining the periphery of a concrete panel (molding) 13 made of a cellular concrete or the like. This shuttering 14 is formed of four columnar members arranged in the front and rear and to the right and left in a direction perpendicularly intersecting the paper surface in FIG. 1, out of these columnar members, ones 14A arranged in the front and rear and to the left in FIG. 1 are rotatably supported at respective side edges by the shuttering bed 11, and, when the shuttering bed 11 is carried onto the erectable frame 4, leave the side surfaces of the concrete panel 13 and are laid down to the sides of the shuttering bed 11, while, the remaining columnar member 14B arranged to the right in the drawing is merely rested on the shuttering bed 11, and, when the shuttering bed 11 is carried onto the erectable frame 4, remains positioned on the shuttering bed 11. Furthermore, provided on the undersurface of the shuttering bed 11 are a pair of engageable members 15 arranged in the front and rear in FIG. 1 (Refer to FIG. 4), which are provided at positions adjacent the rail 9 shown to the left in FIG. 1, and each formed at the lower portions thereof with an engageable recess 15A being U-shaped in cross section and having an opening towards the rail 9 to the left.

Figure 2:
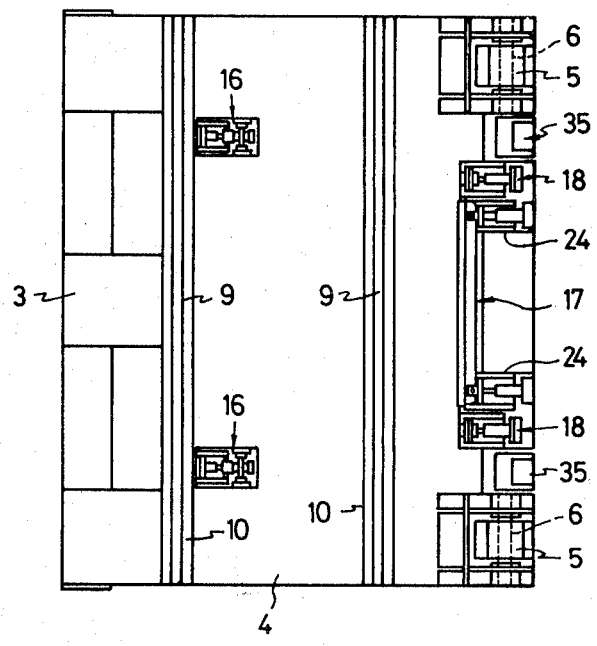
FIG. 2 is a plan view, partly omitted, thereof.
Figure 3:
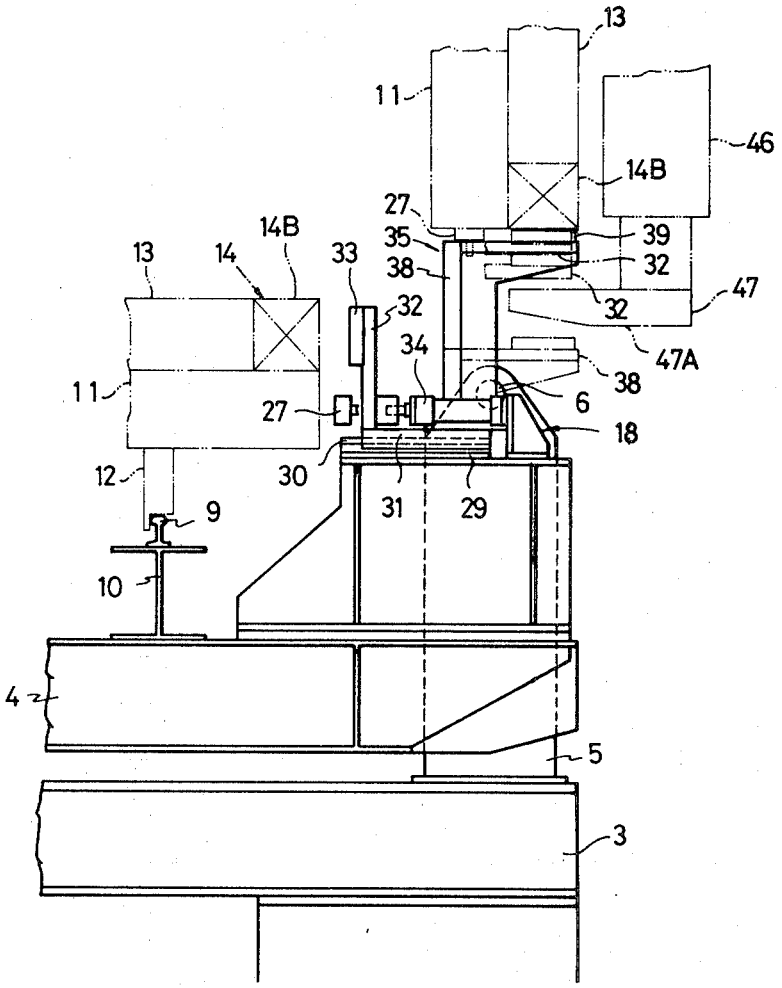
FIG. 3 is an enlarged side view showing the essential portions thereof.
Figure 4:
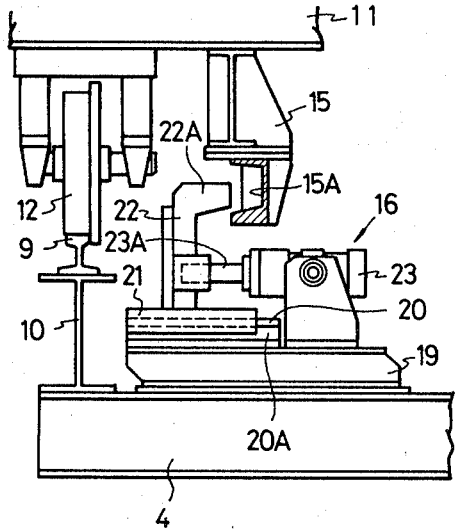
FIG. 4 is an enlarged side view showing the clamp mechanism used in this embodiment.
Figure 5:
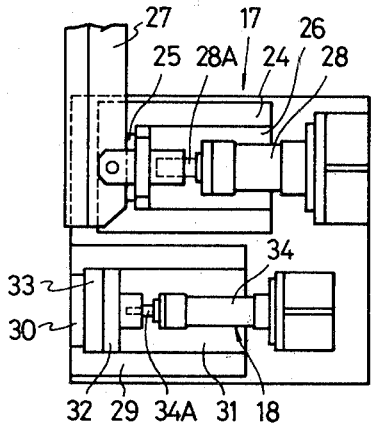
FIG. 5 is an enlarged plan view showing respective portions of the shuttering bed urging mechanism and the molding supporting mechanism used in this embodiment.
Figure 6:
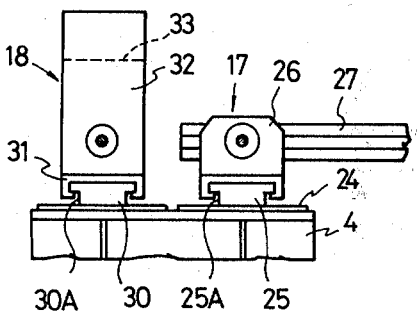
FIG. 6 is a rear view, partly omitted, thereof.

A pair of clamp mechanisms 16 engageable with the engageable members 15 formed on the undersurface of the shuttering bed 11 are provided on the erectable frame 4 (Refer to FIGS. 2 and 4), a shuttering bed urging mechanism 17 is disposed at the central portion to the right in FIG. 2, and further, molding supporting mechanisms 18 are provided at the upper and lower positions in FIG. 2 (Refer to FIGS. 5 and 6).

As shown in FIG. 4, each of the clamp mechanisms comprises: a base 19 fixed onto the erectable frame 4; a guide rail 20 fixed onto the base 19 and formed at opposite sides thereof with guide grooves 20A; a slidable member 21 coupled to the guide rail 20 and slidable along the guide rail 20; a projected member 22 erected on the slidable member 21 and having an engaging projection 22A engageable with the engageable recess 15A of the engageable member 15; and a cylinder 23 rotatably supported on the base 19 through trunnions and the forward end of a piston rod 23A of which is connected to the projected member 22, so that the action of the cylinder 23 can engage the engaging projection 22A with the engageable recess 15A of the engageable member 15 fixed to the shuttering bed 11 or disengage the former from the latter.

As shown in FIGS. 2, 5 and 6, the shuttering bed urging mechanism 17 comprises: a pair of bases 24 provided on the erectable frame 4 in a manner to be spaced apart a predetermined distance from each other; guide rails 25 fixed onto these bases 24, respectively, and formed at opposite sides thereof with guide grooves 25A; slidable members 26 coupled to the guide rails 25 and slidable along the guide rails 25; an urging member 27 racked across these slidable members 26; and cylinders 28 disposed on the base 24, respectively, and the forward ends of piston rods 28A of which are connected to the respective slidable members 26, whereby the actions of these cylinders 28 cause the urging member 27 to abut against the side surface of the shuttering bed 11 to urge the latter, so that this urging force can positively support the shuttering bed 11 in cooperation with the engaging force of the clamp mechanisms 16. Here, the shuttering bed urging mechanism 17, the clamp mechanisms 16 and the engageable members 15 constitute a shuttering bed securing mechanism.

As shown in FIGS. 2, 3, 5 and 6, the molding supporting mechanisms 18 comprise: bases 29 provided at opposite sides of the shuttering bed urging mechanism 17, respectively; guide rails 30 fixed onto these bases 29, respectively, and formed at opposite sides thereof with guide grooves 30A, respectively; slidable members 31 coupled to the guide rails 30, respectively, and slidable along the guide rails 30; brackets 32 erected on these slidable members 31, respectively; abutting pads 33 projectedly provided on the upper portions of these support brackets 32 and not abutting against the shuttering bed 11, but, abutting against only the columnar member 14B of the shuttering 14; and cylinders 34 fixed onto the bases 29, respectively, and the forward ends of piston rods 34A of which are connected to the respective support brackets 32, whereby the actions of the cylinders 34 cause the abutting pads 33 to abut against the columnar member 14B, so that the panel 13 can be supported by way of this columnar member 14B when the erectable frame 4 is erected to a vertical position.

Figure 7:
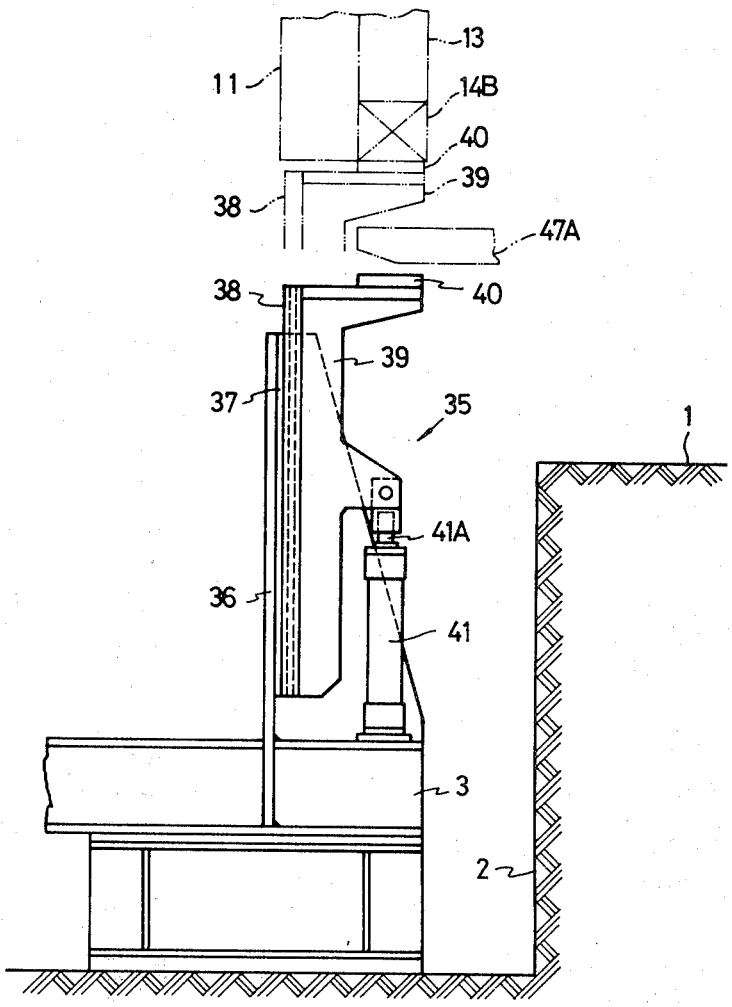
FIG. 7 is an enlarged side view showing the molding receiving mechanism used in this embodiment.

Provided on the base frame 3 are molding receiving mechanisms 35 disposed at positions not interfering with the erectable frame 4 at opposite sides of the molding supporting mechanisms 18 (Refer to FIG. 2). Each of these molding receiving mechanisms 35, as enlargedly shown in FIG. 7, comprises: a bracket 36 erected on the base frame 3; a guide rail 37 fixed to the bracket 36 and being similar to that provided in the clamp mechanisms 16 and the like; a slidable member 38 slidably coupled to this guide rail 37; a receiving member 39 integrally fixed to this slidable member 38 and formed into a T shape as viewed from right side in FIG. 7; an abutting pad 40 projectedly provided on this receiving member 39 and not abutting against the shuttering bed 11, but, abutting against only the columnar member 14B; and a cylinder 41 fixed onto the base frame 3 and the forward end of a piston rod 41A of which is connected to the receiving member 39, so that the panel 13 can be received, which is supported by the molding supporting mechanisms 18 of the erectable frame 4 being in the erected state through the columnar member 14B.

As shown in FIG. 1, a panel carry-out carrier support frame 42 is provided at a position upwardly of the shaft 6 of the base frame 3, and a panel carry-out carrier 43 of a chain traction type, a self-travelling type or the like is supported through wheels 44 by this support frame 42 in a manner to be movable in a direction perpendicularly intersecting the paper surface in FIG. 1. This carrier 43 comprises: a working table 45; a pair of guide supports 46 provided at the front and rear positions in a direction perpendicularly intersecting the paper surface in FIG. 1; forks 47 slidably supported on these supports 46, respectively, vertically movable by means of cylinders, not shown, and projectedly formed at the lower ends thereof with support portions 47A, respectively; and a hook engaging mechanism 48 rotatable in the horizontal direction, provided thereon with arms 48A having grooves engageable with lifting hooks 13A projectedly provided on the panel 13, and supported by one of the guide supports 46, so that the driving of a driving source, can transfer the carrier 43 from a position for receiving the panel 13 to a position for the succeeding step of work.

Vertically movably provided on the support frame 42 is a panel support base 49, which is adapted to be vertically movable by means of a cylinder 50. Furthermore, a hook clamp mechanism 51 having a clamping cylinder, not shown, is provided on the support base 49, and this clamp mechanism 51 clamps the lifting hooks 13A of the panel 13 in an erected state, so that the panel 13 can be secured in the erected state until the arms 48A of the hook engaging mechanism 48 are engaged with the hooks 13A.

Description will hereunder be given of action of this embodiment.

Under a condition that the piston rod 8 of the cylinder 7 provided on the base frame 3 is in a retracted state and the erectable frame 4 is in the horizontal position, the shuttering bed 11 is moved onto the rails 9 of the erectable frame 4 through the wheels 12, and is stopped in movement through the action of detecting means such as a limit switch, not shown. This stop in movement causes the cylinders 23 of the clamp mechanisms 16 to operate in the directions of retracting the piston rods 23A, whereby the engaging projections 22A of the projected members 22 are engaged with the engageable recesses 15A of the engageable members 15 and the cylinder 28 of the shuttering bed urging mechanism 17 is caused to operate in the direction of stretching out the piston rod 28A to abut the urging member 27 against the right side surface of the shuttering bed 11 in FIG. 1, so that the shuttering bed 11 can be positively supported at a reference position by the urging of the urging member 27 of this urging mechanism 17 and the engagement of the clamp mechanisms 16 with the engageable members 15.

When this shuttering bed 11 is carried onto the erectable frame 4, out of the shuttering 14 defining the periphery of the concrete panel 13 being a molding on the shuttering bed 11, the columnar member 14A in the front, rear (one in the rear is not shown) and in the left in FIG. 1 are released from the peripheral surfaces of the panel 13 and brought into states of being laid down to the sides of the shuttering bed 11, and only the columnar member 14B remains left on the shuttering bed 11.

The cylinders 34 of the molding supporting mechanisms 18 are caused to operate in the directions of stretching out the piston rods 34A simultaneously or slightly behind the actions of the clamp mechanisms 16 and the urging mechanism 17, whereby the abutting pad 33 is abutted against the columnar member 14B at the right side of the shuttering 14.

Subsequently, the erecting cylinder 7 is caused to operate in the direction of stretching out the piston rod 8, whereby the erectable frame 4 holding the shuttering bed 11 is erected to a substantially vertical position, where the latter is stopped in movement by means of detecting means such as a limit switch, not shown. This stop in movement causes the cylinders 41 of the molding receiving mechanisms 35 to operate in the directions of stretching out the piston rods 41A, so that the abutting pads 40 can abut against the columnar member 14B on the right side of the shuttering 14 (Refer to a position indicated by two-dot chain lines in FIG. 7). This abutment causes the cylinders 34 of the molding supporting mechanisms 18 to operate in directions opposite to those as described above, i.e. the directions of stretching out the piston rods 34A, so that the concrete panel 13 can be supported on the side of the abutting pads 40 of the receiving mechanisms 35 through the columnar member 14B (Refer to FIG. 3).

Until the panel 13 is supported by the receiving mechanisms 35 after the panel 13 is erected, or after the panel 13 is supported, firstly, the cylinder 50 of the panel support base 49 is operated, whereby the support base 49 is lowered to allow the hook clamp mechanism 51 to clamp the hooks 13A, and subsequently, the hook clamp mechanism 51 is operated to support the hooks 13A.

Thereafter, the cylinder 7 is operated in a direction opposite to that as described above, i.e. a direction of retracting the piston rod 8, whereby the erectable frame 4 is laid down to return to the horizontal position. In this case, the shuttering bed 11 is still secured to the erectable frame 4, whereby the shuttering bed 11 is released from the panel 13 and the shuttering bed 11 is laid down together with the three columnar members 14A secured thereto. Upon completion of this laydown, both the cylinders 23 of the clamp mechanisms 16 and the cylinder 28 of the shuttering bed urging mechanism 17 are operated in directions opposite to those as described above, so that the shuttering bed 11 is released from the secured state.

The shuttering bed 11, which has been released from the secured state, is moved towards the side of carryout with the wheels 12 being driven, whereby a new shuttering bed 11, i.e. another shuttering bed 11 having mounted thereon a concrete panel 13 is moved onto the erectable frame 4, so that the new shuttering bed 11 can be secured.

On the other hand, the lifting hook engaging mechanism 48 of the carrier 43, which has been moved to a predetermined position, is opposed to the hooks 13A of the panel 13 supported by means of the hook clamp mechanism 51, and then, operated, whereby the arms 48A are engaged with the hooks 13A. Upon completion of the engagement of the arms 48A, the clamping by the hook clamp mechanism 51 is released, and subsequently, the cylinder 50 is operated in a direction opposite to that as described above, whereby the panel support base 49 is raised, so that the panel 13 can be ready for being carried out by means of the carrier 43.

Furthermore, simultaneously with the action of the hook engaging mechanism 48 or upon completion of the engagement, the forks 47 are operated in the upward direction, whereby the support portions 47A abut against the columnar member 14B, so that the upward movement of the forks 47 can be stopped by detecting means such as limit switches, not shown.

This stop in the upward movement causes the cylinders 41 of the molding receiving mechanisms 35 to operate in directions opposite to those as described above, whereby the abutting pads 40 are lowered, so that the panel 13 can be supported by support portions 47A of the forks 47. The cylinders 41 of the receiving mechanisms 35 are operated to reach stroke ends in directions of retracting, where the latter are stopped and ready for receiving the succeeding panel 13.

The panel 13 thus supported on the forks 47 and prevented by the arms 48A of the hook engaging mechanism 48 from falling off and so forth is carried out to a predetermined position for the succeeding step of work due to the movement of the carrier 43, whereby the succeeding vacant carrier 43 not supporting a panel 13 is moved to a position corresponding to the erectable frame 4 due to the movement of the carrier 43 supporting the aforesaid panel 13, so as to be ready for supporting the succeeding panel 13.

Thus, the abovedescribed operation is repeated, so that the releasing work can be automatically carried out.

In the abovedescribed embodiment, only the concrete panel 13 being a molding is received by means of the receiving mechanisms 35 in the state of the erectable frame 4 being erected, and immediately after the receiving, the erectable frame 4 is laid down, so that the releasing work from the molding can be continuously carried out at a high efficiency. Furthermore, the shuttering bed 11 is positively supported by the shuttering bed securing mechanism constituted by the clamp mechanisms 16, the shuttering bed urging mechanism 17 and the engageable members 15, so that the operation can be carried out in safety without a fear of the falldown and so forth. Further, the hydraulic pressure-operated cylinders are used as the driving sources for all of the components including the erectable frame 4, the clamp mechanisms 16, the shuttering bed urging mechanism 17, the molding receiving mechanisms 35, the forks 47, the panel support base 49, the hook clamp mechanism 51 and so forth, so that the automatic operation combined with suitable detecting means can be effected by the suitable design of the hydraulic pressure circuits, thereby enabling to achieve labor saving and decrease the operating costs to a considerable extent.

Furthermore, in working the present invention, the shuttering bed securing mechanism constituted by the clamp mechanisms 16 and so forth may be of a modified arrangement, and in short, any arrangement may be adopted, which can positively support the shuttering bed 11. Additionally, the driving sources are not limited to the cylinders, but, any other means such as electric motors may be used. Further, the direction of carrying in shuttering bed 11 should not necessarily be horizontal as in the abovedescribed embodiment, and the direction may be inclined to some extent in association with the preceding step of work. Furthermore, the concrete panel being a molding is not limited to the concrete panel 13, but, may be any other type of molding. Further, the concrete panel 13 being a molding may be directly supported by the abutting pads, 33, 40 and so forth, without using the columnar members 14B.

As has been described hereinabove, the present invention can offer such an advantage as to provide the releasing apparatus capable of releasing the shuttering and the like from the molding such as a concrete panel at a high efficiency.

What is claimed is:

1. A releasing apparatus comprising:

a base frame;

a shuttering bed on which to mold a molding and an associated columnar member along an edge of the molding and removable therewith from said shuttering base;

an erectable frame supported by said base frame for erecting and laying down said shuttering bed between a shuttering bed carry-in position and a shuttering bed upright position; and molding receiving means provided on said base frame for (1) receiving only a molding together with said removable columnar member from said shuttering bed supported by the erectable frame in its erected state, and (2) taking over support of said molding and removable columnar member from the erectable frame, to permit the erectable frame to be laid down;

said molding receiving means each including a bracket erected on the base frame, a slidable member slidably coupled to said bracket, a receiving member affixed to said slidable member and supporting at the top surface thereof against only the removable columnar member and molding, and a driving mechanism connected to said receiving member for vertically moving same.

2. A releasing apparatus as set forth in claim 1, wherein each of said molding receiving means further comprises:

a guide rail vertically provided on said bracket;

said slidable member being slidable on said guide rail;

said receiving member being provided on the top surface thereof with an abutting pad for abutting against the removable columnar member; and said driving mechanism being a cylinder having vertically movably mounted thereon said receiving member.

3. A releasing apparatus as set forth in claim 1, wherein said erectable frame is provided on its upper surface with a pair of rails for the carry-in of the shuttering bed, and said shuttering bed is provided on its under surface with wheels for movement along said rails.

4. A releasing apparatus as set forth in claim 1, wherein a forward end of a piston rod of a cylinder is rotatably secured to said erectable frame, and an intermediate portion of said cylinder is rotatably mounted to said base frame.

5. A releasing apparatus as set forth in claim 1, including a shuttering bed securing means for positively but releasably fixing the shuttering bed on said erectable frame for erection therewith;

molding supporting means provided on said erectable frame and operable independently of said shuttering bed securing mechanism for abutting against a side surface of the molding formed on the shuttering bed and supporting only the molding when the erectable frame is erected.

6. A releasing apparatus as set forth in claim 5, wherein said shuttering bed securing mechanism comprises:

engageable members provided on the undersurface of the shuttering bed;

clamp means provided on the erectable frame for releasable engagement with said engageable members; and a shuttering bed urging means for urging a side surface of the shuttering bed to firmly engage said engageable members with the clamp means.

7. A releasing apparatus as set forth in claim 6, wherein said engageable members are each provided therein with an engageable recess of C-shaped cross section, and each of said clamp means comprises a guide rail provided on the upper surface of the erectable frame; a slidable member slidably coupled to said guide rail; a projected member erected on the slidable member and having an engaging projection engageable with an engageable recess formed in said engageable member; and a cylinder connected to said projected member and rotatably mounted in a manner to be movable in a direction of engaging an engaging projection with said engageable recess or disengaging the former from the latter.

8. A releasing apparatus as set forth in claim 6, wherein said shuttering bed urging means comprises:

a pair of guide rails provided at one side of the upper surface of said erectable frame;

slidable members slidably coupled to said guide rails, respectively;

an urging member racked across said slidable members; and cylinders connected to said slidable members and movably mounted so as to urge a side surface of the shuttering bed through said urging member.

9. A releasing apparatus as set forth in claim 5, wherein said molding supporting means comprise:

guide rails formed at opposite sides of the shuttering bed urging mechanism in the shuttering bed securing mechanism;

slidable members slidably coupled to said guide rails;

abutting pads for abutting against only a side surface of said removable columnar member of said shuttering bed, through brackets erected on said slidable members; and cylinders connected to said support brackets and mounted in a manner to be movable in directions of abutting said pads against said removable columnar member.

10. A releasing apparatus as set forth in claim 1, including:

a shuttering bed securing means comprising engageable members provided on the undersurface of the shuttering bed, clamp means provided on the erectable frame for engagement with said engageable members, and a shuttering bed urging means for urging a side surface of the shuttering bed to firmly engage said engageable members with the clamp mechanisms;

molding supporting means comprising guide rails formed at opposite sides of the shuttering bed urging means in the shuttering bed securing means, slidable members slidably coupled to said guide rails, abutting pads for abutting against only a side surface of said removable columnar member of said shuttering bed, through brackets erected on said slidable members, and cylinders connected to said support brackets and mounted in a manner to be movable in directions of abutting said pads against said removable columnar member.

* * * * *